US010132331B2

(12) United States Patent
Mokulys et al.

(10) Patent No.: US 10,132,331 B2
(45) Date of Patent: Nov. 20, 2018

(54) RADIAL COMPRESSOR STAGE

(71) Applicants: Thomas Mokulys, Wuerenlingen (CH); Sebastiano Mauri, Zurich (CH); Marcel Bühler, Urdorf (CH); Damian Schärz, Berikon (CH); Christian Rufer, Elgg (CH)

(72) Inventors: Thomas Mokulys, Wuerenlingen (CH); Sebastiano Mauri, Zurich (CH); Marcel Bühler, Urdorf (CH); Damian Schärz, Berikon (CH); Christian Rufer, Elgg (CH)

(73) Assignee: MAN Energy Solutions SE, Augsburg (DE)

( * ) Notice: Subject to any disclaimer, the term of this patent is extended or adjusted under 35 U.S.C. 154(b) by 423 days.

(21) Appl. No.: 14/572,247

(22) Filed: Dec. 16, 2014

(65) Prior Publication Data

US 2015/0167696 A1 Jun. 18, 2015

(30) Foreign Application Priority Data

Dec. 17, 2013 (DE) ..... 10 2013 020 826

(51) Int. Cl.
*F04D 29/66* (2006.01)
*F04D 29/30* (2006.01)
(Continued)

(52) U.S. Cl.
CPC ..... *F04D 29/666* (2013.01); *F04D 17/10* (2013.01); *F04D 29/162* (2013.01);
(Continued)

(58) Field of Classification Search
CPC ..... F04D 17/10; F04D 25/024; F04D 29/685; F04D 25/045; F04D 29/30;
(Continued)

(56) References Cited

U.S. PATENT DOCUMENTS 3,893,787 A 7/1975 Jones
6,129,510 A 10/2000 Martin
(Continued)

FOREIGN PATENT DOCUMENTS

CN 102066717 5/2011
DE 195 02 808 A1 8/1996
(Continued)

OTHER PUBLICATIONS

Office Action dated Jul. 3, 2018 which issued in the corresponding Chinese Patent Application No. 201410780176.3.
(Continued)

*Primary Examiner* — Justin Seabe
*Assistant Examiner* — Brian P Wolcott
(74) *Attorney, Agent, or Firm* — Cozen O'Connor

(57) ABSTRACT

In a radial compressor stage for a radial compressor having a rotor side, the radial compressor stage includes a stator; and an impeller configured to rotate relative to the stator. The impeller has multiple impeller blades on the rotor side. Each of the multiple impeller blades has: a flow inlet edge, a flow outlet edge, a suction side extending between the flow inlet edge and the flow outlet edge, a pressure side, and an outer surface facing the stator. At least one groove is arranged in the outer surface of at least one of the multiple impeller blades, the at least one groove being bounded by a longitudinal web both on the suction side and on the pressure side. Each of the longitudinal webs forms a sealing tip of the respective impeller blade towards the stator.

11 Claims, 5 Drawing Sheets

(51) Int. Cl.
*F04D 29/16* (2006.01)
*F04D 29/28* (2006.01)
*F04D 17/10* (2006.01)

(52) U.S. Cl.
CPC ..... *F04D 29/284* (2013.01); *F04D 29/30* (2013.01); *F05D 2240/307* (2013.01)

(58) Field of Classification Search
CPC .. F04D 29/4206; F04D 29/162; F04D 29/284; F04D 29/666; F01D 5/048; F05D 2240/307
See application file for complete search history.

(56) References Cited

U.S. PATENT DOCUMENTS

| | | | | |
|---|---|---|---|---|
| 2007/0077147 | A1 | 4/2007 | Higashimori et al. | |
| 2009/0162200 | A1* | 6/2009 | Tibbott | F01D 5/20 416/91 |
| 2011/0091323 | A1 | 4/2011 | Koike et al. | |
| 2011/0255990 | A1* | 10/2011 | Diamond | F01D 5/20 416/97 R |
| 2015/0086395 | A1 | 3/2015 | Dextraze et al. | |
| 2015/0118079 | A1 | 4/2015 | Dextraze et al. | |

FOREIGN PATENT DOCUMENTS

| | | | | |
|---|---|---|---|---|
| DE | 10305351 | | 8/2004 | |
| DE | 10305351 | A1 * | 8/2004 | F01D 5/20 |
| DE | 10305251 | | 10/2004 | |
| DE | 10 2012 203 801 | A1 | 9/2013 | |
| DE | 112013001507 | T5 | 3/2015 | |
| EP | 1 591 624 | | 11/2005 | |
| EP | 1591624 | A1 * | 11/2005 | F01D 5/141 |
| JP | 08-170598 | | 7/1996 | |
| PH | 05-272494 | | 10/1993 | |
| WO | WO 2013/162874 | | 10/2013 | |
| WO | WO 2013/162896 | | 10/2013 | |
| WO | WO 2013162874 | A1 * | 10/2013 | F04D 29/4206 |

OTHER PUBLICATIONS

Office Action dated Apr. 23, 2018 which issued in the corresponding Japanese Patent Application No. 2014-252798.

* cited by examiner

RADIAL COMPRESSOR STAGE

BACKGROUND OF THE INVENTION

1. Field of the Invention

The invention relates to a radial compressor stage for a radial compressor.

2. Description of the Related Art

From DE 195 02 808 C2 and from DE 10 2012 203 801 A1 the fundamental structure of a radial compressor with at least one radial compressor stage is known. Accordingly, it is disclosed in this state of the art that the, or each, radial compressor stage of a radial compressor comprises an impeller that rotates with respect to a stator, wherein the impeller comprises multiple impeller blades on the rotor side. Each impeller blade of an impeller accordingly comprises a flow inlet edge and a flow outlet edge, wherein between the flow inlet edge and the flow outlet edge of each impeller blade a suction side, a pressure side and an outer surface facing the stator extend, wherein the outer surface of the respective impeller blade borders on the stator and serves for the sealing with respect to the stator. Such an impeller of a radial compressor, in which the outer surfaces of the impeller blades indirectly border on the stator, does not have a cover band and is also called an open impeller.

Under unfavorable operating conditions, the outer surfaces of the impeller blades of an impeller can run into the stator or rub against the stator, as a result of which damage in the region of the outer surfaces of the impeller blades and of the stator can occur. In particular when, for reducing the risk of damage on the outer surfaces of the impeller blades of an impeller facing the stator, material is removed for reducing the material thickness of the impeller, the sealing effect in the region of the outer surfaces of the impeller blades relative to the stator deteriorates.

There is a need for a radial compressor stage in which the risk of damage in the region of the outer surfaces of the impeller blades is reduced, in which however a good sealing effect of the outer surfaces with respect to the stator is ensured.

SUMMARY OF THE INVENTION

Starting out from this, it is an object of the present invention to provide a radial compressor stage for a radial compressor that fulfils the above requirements.

According to a first aspect of the invention, this object is solved through a radial compressor stage in which at least one groove is introduced into the outer surface of at least one impeller blade bounded both on the suction side and also on the pressure side by a longitudinal web, wherein each of the longitudinal webs forms a sealing tip of the respective impeller blade towards the stator.

According to an aspect of the invention, at least one groove is introduced into the outer surface of at least one impeller blade of an impeller, which groove is bounded both on the suction side of the respective impeller blade and also on the pressure side of the respective impeller blade by a longitudinal web that preferentially extends continuously between the flow inlet edge and the flow outlet edge. Each of the longitudinal webs forms a sealing tip of the respective impeller blade towards the stator of the radial compressor stage. In this manner, an improved sealing effect in the region of the outer surfaces of the impeller blades of a radial compressor impeller relative to the stator can be ensured on the one hand, while there is a reduced risk of damage during the rubbing or running-in of the outer surfaces of the impeller blades into the stator on the other hand. Both in the region of the pressure side and also in the region of the suction side of each impeller blade an optimal aerodynamic contour is provided by the respective longitudinal web so that the radial compressor stage has a high efficiency.

According to an advantageous further development, a single groove is introduced into the outer surface of the respective impeller blade which extends between the flow inlet edge and the flow outlet edge. Preferentially, the respective groove is closed adjacent to the flow inlet edge and open adjacent to the flow outlet edge. According to an alternative advantageous further development, the respective groove is open in each case adjacent to the flow inlet edge and adjacent to the flow outlet edge.

In particular when the respective groove is formed open adjacent to the flow inlet edge through a recess in one of the webs, the same can be produced more easily through milling than in the case in which the grooves are embodied closed adjacent to the flow inlet edge of the respective impeller blade.

According to an alternative advantageous further development, multiple grooves are introduced into the outer surface of the respective impeller blade which are positioned one behind the other between the flow inlet edge and the flow outlet edge and are separated from one another by at least one transverse web. Preferentially, a front groove is closed at the front adjacent to the flow inlet edge and closed at the back, wherein a rear groove is closed at the back adjacent to the flow outlet edge and closes at the front.

Preferentially, the groove introduced into the outer surface of the respective impeller blade has a V-shaped cross section and a U-shaped or rounded-off groove base. This contouring is advantageous on the one hand for ensuring a good sealing effect and on the other hand for ensuring a good rubbing behavior and the mechanical integrity of the impeller blade.

According to a further advantageous further development, the grooves of all impeller blades of the respective impeller have identical groove depths. According to an advantageous further development, a groove of at least one impeller blade of the respective impeller has a groove depth that is different with respect to the grooves of the other impeller blades of the respective impeller. By way of different groove depths of the grooves of a radial compressor impeller, natural frequencies of the impeller blades can be adjusted in order to ensure optimal operating behavior of the radial compressor. Furthermore, different groove depths of adjacent impeller blades can be utilized for balancing the radial compressor impeller.

According to a second aspect of the invention, this object is solved through a radial compressor stage in which multiple recesses are introduced into the outer surface of at least one impeller blade which are bounded on the suction side and also on the pressure side by rims, wherein the rims of the recesses form sealing contours of the respective impeller blade towards the stator. In this manner, too, an improved sealing effect in the region of the outer surfaces of the impeller blades with respect to the stator can also be ensured on the one hand while there is a reduced risk of damaging during the rubbing of the outer surfaces at the stator.

Preferentially, the recesses introduced into the outer surface of the respective impeller blade are formed as bores which have different dimensions. This embodiment is particularly simple. By way of bores with different dimensions, natural frequencies of the impeller blades can be adjusted while such bores, furthermore, can be utilized for balancing the radial compressor impeller.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWING

Preferred further developments of the invention are obtained from the following description. Exemplary embodiments of the invention are explained in more detail with the help of the drawings without being restricted to this. In the drawings.

DETAILED DESCRIPTION OF THE PRESENTLY PREFERRED EMBODIMENTS

Figure 1:
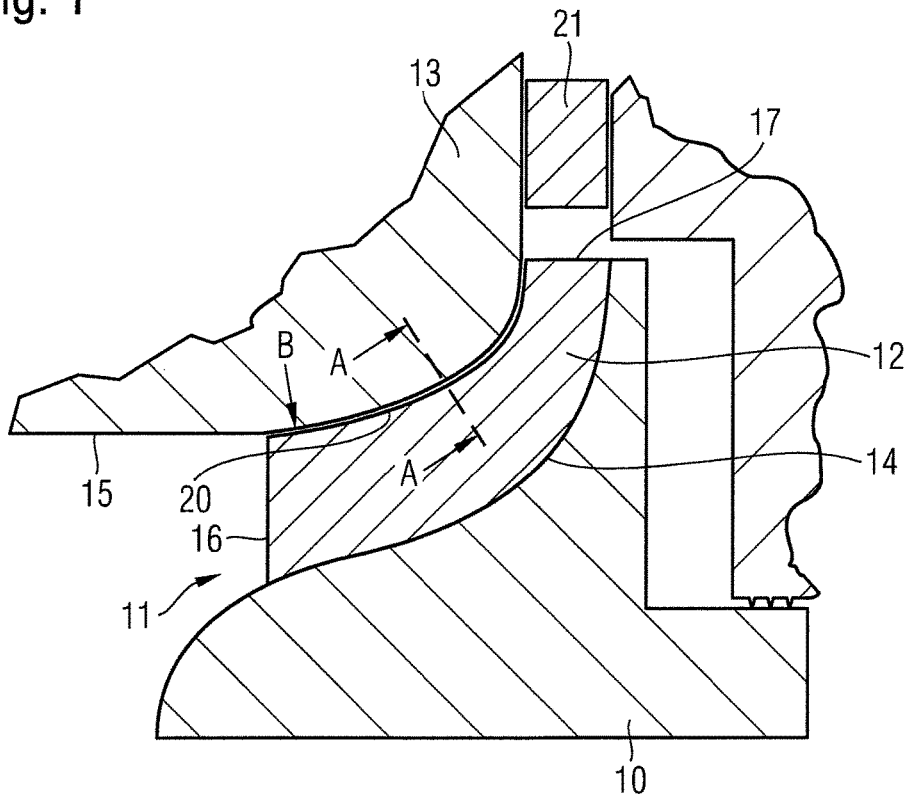
FIG. 1: is a detail of a radial compressor stage according to the invention according to a first aspect of the invention in meridional section.

The present invention relates to a radial compressor with at least one radial compressor stage. FIG. 1 shows a detail of a radial compressor stage according to the invention in meridional section according to a first aspect of the invention.

The, or each, radial compressor stage of a radial compressor comprises an impeller 10 with multiple impeller blades 12 on the rotor side arranged in a flow channel 11 of the respective compressor stage. The impeller 10 rotates relative to a stator 13. The stator 13 can be a housing or a stator ring or the like.

The flow channel 11 of the respective compressor stage is bounded by a hub contour 14 on the rotor side and a stator contour 15. Each impeller blade 12 comprises a flow inlet edge 16 and a flow outlet edge 17.

Figure 2:
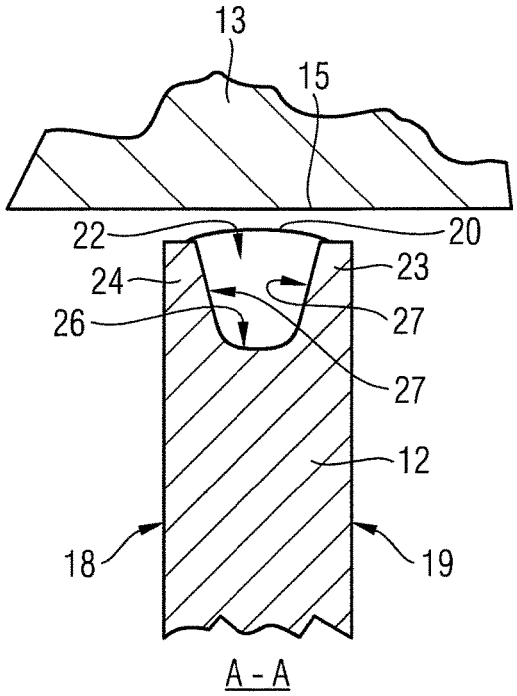
FIG. 2: is a view in section direction A-A of FIG. 1.

According to the exemplary embodiment of FIGS. 1 and 2, the flow inlet edge 16 is defined by a rounded-off areal contour. The flow outlet edge 17 by contrast is defined according to FIGS. 1 and 2 by a flat, not rounded-off, areal contour.

Between the flow inlet edge 16 and the flow outlet edge 17 of each impeller blade 12 a pressure side 18, a suction side 19 and radially outside on the impeller blade 12, an outer surface 20 of the respective impeller blade 12 facing the stator 13 extend.

According to FIG. 1, a diffuser on the stator side with fixed guide blades 21 is positioned in the flow channel 11 seen in flow direction downstream of the impeller blades 12 of the impeller 10. The diffuser is not part of the radial compressor stage. Such a diffuser can also be omitted.

At least one groove 22 is introduced into the outer surface 20 facing the stator 13 of at least one impeller blade 12, preferentially of each impeller blade 12, of a radial compressor impeller 10.

In the exemplary embodiments of FIGS. 1 to 8, a single groove is introduced into the outer surface 20 of the respective impeller blade 12, the groove extending between the flow inlet 16 and the flow outlet edge 17, and the groove being bounded both on the pressure side 18 and also on the suction side 19 by a longitudinal web 23 and 24 respectively extending between the flow inlet edge 16 and the flow outlet edge 17.

Each of the longitudinal webs 23, 24 forms a sealing tip of the respective impeller 10 towards the stator 13 of the radial compressor stage.

Figure 3:
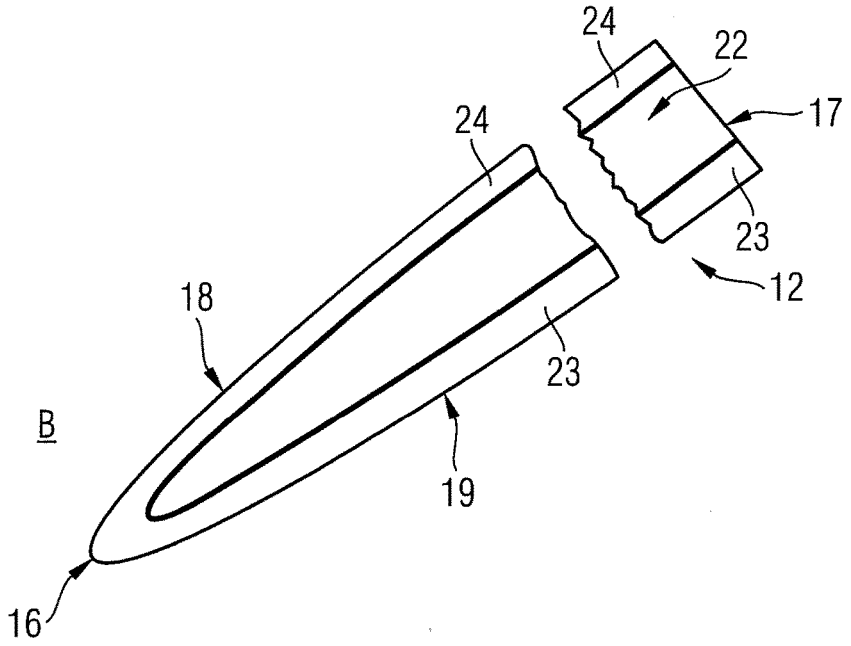
FIG. 3: is a view in viewing direction B of FIG. 1.
Figure 4:
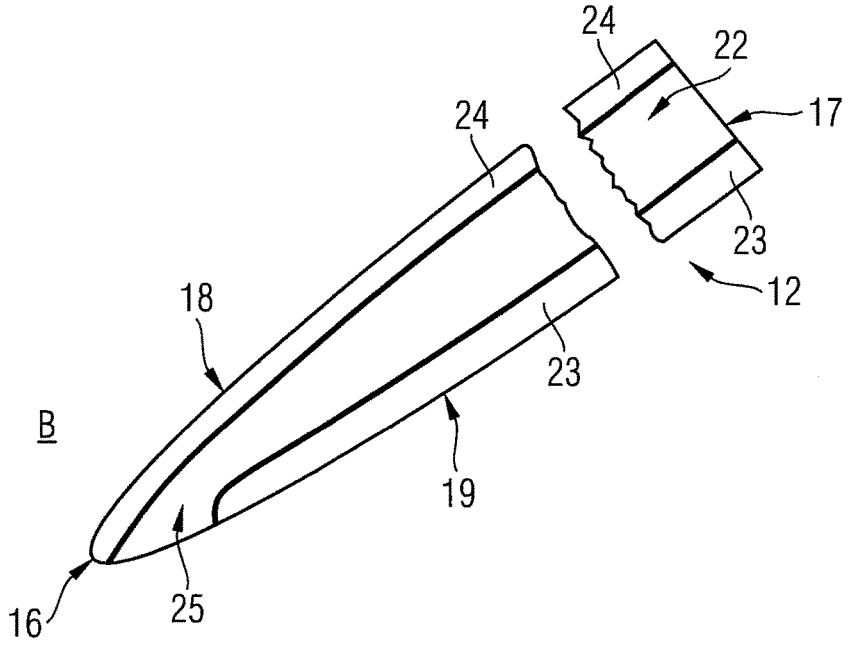
FIG. 4: is an alternative view in viewing direction B of FIG. 1.

In the version of FIG. 3, the respective groove 22, which is formed on the outer surface 20 of an impeller blade 12, is closed adjacent to the flow inlet edge 16. In the alternative of FIG. 4 by contrast, the respective groove 22 is formed so as to be open adjacent to the flow inlet edge 16 of the respective impeller blade 12, wherein the groove 22, via a recess 25 in the longitudinal web 23 on the suction side or pressure side, opens into the region of the suction side 19 of the respective impeller blade 12.

The version of FIG. 4 can be produced more easily by milling than the version of FIG. 3. For aerodynamic reasons, however, the version of FIG. 3 is preferred. In both versions of FIGS. 3 and 4, the respective groove 22 is designed open adjacent to the flow outlet edge 17, which is not shown.

As is evident from FIG. 2, the groove 22 introduced into the outer surface 20 of the respective impeller blade 12 has a V-shaped cross section and a rounded-off or U-shaped groove base 26, wherein lateral legs 27 of the longitudinal webs 23, 24, which bound the groove 22 that is V-shaped in cross section, diverge towards the outside or in the direction of the outer surface 20 of the respective impeller blade 12. Preferentially, each of the longitudinal webs 23, 24 formed on the outer surface 20 of each impeller blade 12 has a constant thickness on its outer section in the course between the flow inlet edge 16 and the flow outlet edge 17.

Figure 5:
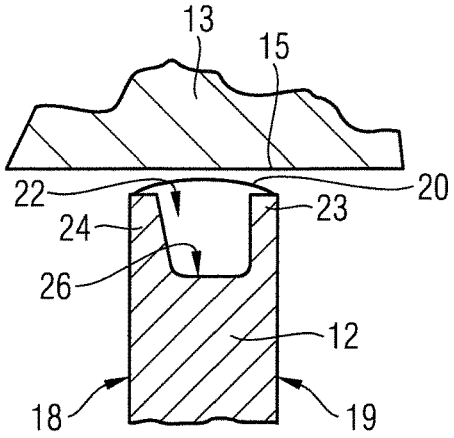
FIG. 5: is an alternative view in section direction A-A of FIG. 1.
Figure 7:
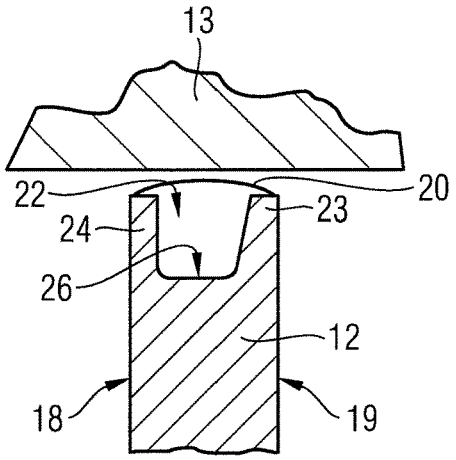
FIG. 7: is a further alternative view in section direction A-A of FIG. 1.

The contouring of the groove 22 introduced into the outer surface 20 of the respective impeller blade 12 shown in FIG. 2 is preferred but need not be mandatorily embodied thus. Accordingly, FIGS. 5 and 7 show versions in which merely one of the longitudinal webs 23, 24 diverges in the direction of the outer surface 20 of the respective impeller blade 12, namely in FIG. 5 the web 24 on the pressure side 18 and in FIG. 7 the web 23 on the suction side 19, whereas the respective other longitudinal web towards the outside in the direction of the outer surface 20 of the respective impeller blade 12 has a constant thickness.

Figure 6:
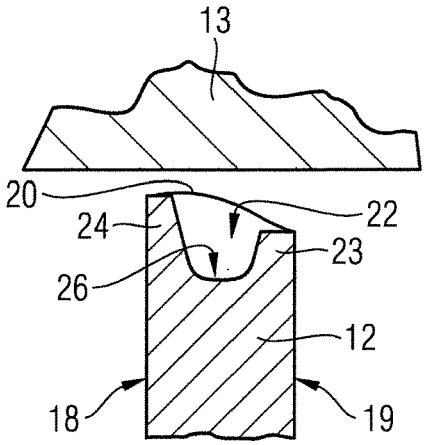
FIG. 6: is a further alternative view in section direction A-A of FIG. 1.

FIG. 6 shows a version in which the web 23 on the suction side 19 is designed shortened towards the outside in the direction of the outer surface 20 of the respective impeller blade 12 relative to the web 24 on the pressure side 18.

According to a first version of the invention, the grooves 22 of all impeller blades 12 of a radial compressor impeller 10 have identical groove depths. In contrast with this it is also possible however to equip a groove 22 of at least one impeller blade 12 of a radial compressor impeller 10 relative to the grooves 22 of the other impeller blades 12 of the radial compressor wheel 10 with a different groove depth, as a result of which the natural frequencies of the impeller blades 12 can be influenced so that optimal operating behavior of the radial compressor impeller 10 and thus of the radial compressor stage are ensured.

Figure 8:
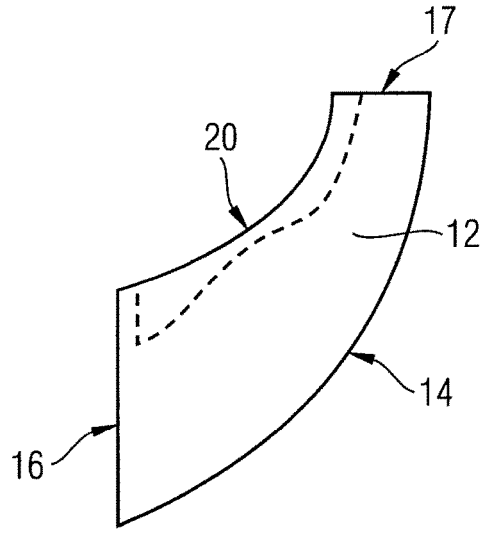
FIG. 8: is a detail of FIG. 1.

The groove depth of the respective groove 22 extending between the flow inlet edge 16 and the flow outlet edge 17 can be constant, or, as shown in FIG. 8, variable along its extension between the flow inlet edge 16 and the flow outlet edge 17. Accordingly, the groove depth in FIG. 8 of the respective groove 22 adjacent to the flow inlet edge 16 and adjacent to the flow outlet edge 17 is deeper in each case than in a middle section of the same. The groove depth accordingly preferentially varies continuously seen in this extension direction, i.e., without steps or the like.

Figure 9:
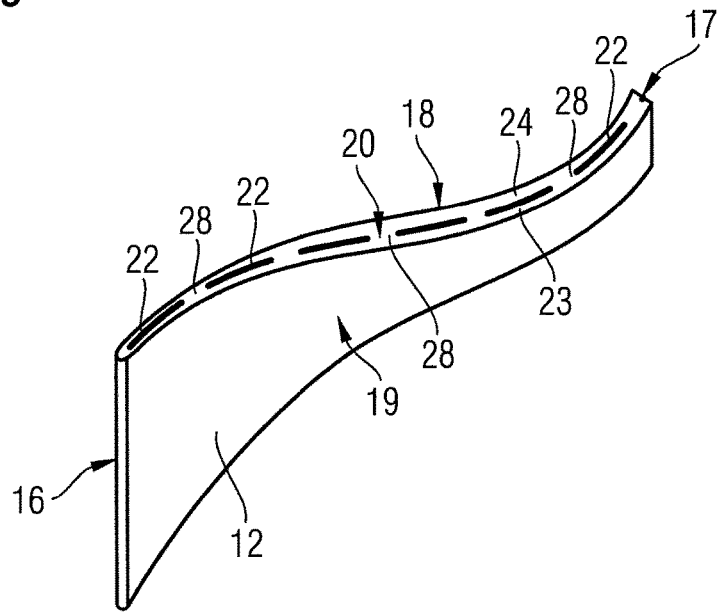
FIG. 9: is a perspective view of an impeller blade according to an alternative configuration of the invention.

FIG. 9 shows a version of the first aspect of the invention, in which in the outer surface 20 of the respective impeller blade 12 multiple grooves 22 are introduced, which are positioned between the flow inlet edge 16 and the flow outlet edge 17 one behind the other and transverse webs 28 are separated from one another. The transverse webs 28 extend between the suction side 19 and the pressure side 18 of the respective impeller blade 12, i.e. transversely to the longitudinal webs 23 and 24 extending between the flow inlet edge 16 and the flow outlet edge 17.

In FIG. 9, a front groove 22 is closed at the front adjacent to the flow inlet edge 16 and closed at the back. A rear groove 22 is closed at the back adjacent to the flow outlet edge 17 and closed at the front. Between the front groove 22 and the rear groove 22, two further grooves 22 are positioned in FIG. 9, which are likewise closed at the front and the back. Accordingly, each of the grooves is closed and at least bounded by the longitudinal webs 23 and 24 as well as by the transverse webs 28. The number of the longitudinal webs can be adapted to the respective requirements of the impeller for the sake of optimizing the aerodynamic losses and the mechanical integrity.

The present invention proposes a radial compressor stage with an impeller 10, which in the region of the outer surfaces 20 of the impeller blades 12 of the same is designed in such a manner that on the one hand an optimal sealing effect and on the other hand an optimal rubbing protection with optimal aerodynamic contours is provided in the region of the suction side 19 and of the pressure side 18.

To this end, at least one groove 22 each in the form of a central channel is introduced in the exemplary embodiments of FIGS. 1 to 9 into the outer surfaces 20 of the impeller blades 12 of the radial compressor impeller 10, wherein both in the region of the pressure side 18 and also in the region of the suction side 19 the grooves 22 are bounded by longitudinal webs 23, 24, so that accordingly pressure side 18 and suction side 19 have optimal aerodynamic characteristics in the region of the outer surfaces 20.

The depth and width of the grooves 22 is adjusted thus in order to provide a good sealing effect on the one hand a good rubbing protection on the other hand.

As explained above, the grooves 22 of the impeller blades 12 of a radial compressor impeller 10 can have different depths, in order to optimally adjust the impeller blade natural frequencies or in order to balance the radial compressor impeller 10.

Figure 10:
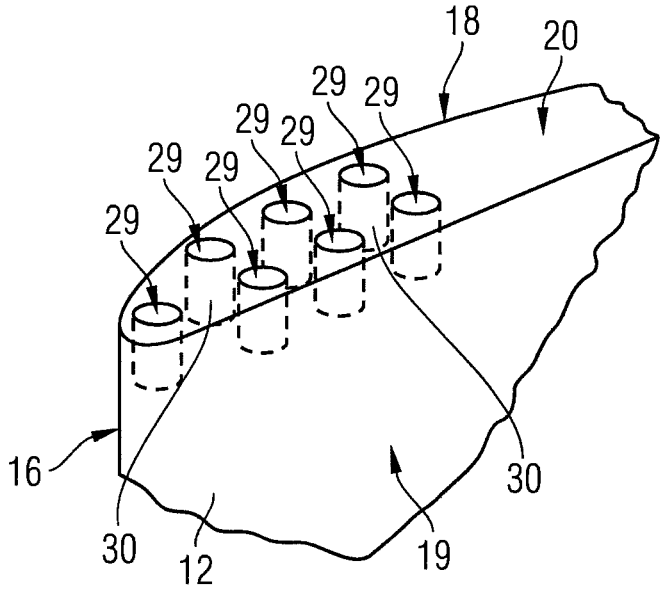
FIG. 10: is a perspective view of an impeller blade for a radial compressor stage according to a second aspect of the invention.

FIG. 10 shows a detail of an impeller blade 12 of a radial compressor stage according to the invention according to a second aspect of the invention, with which the advantages discussed above can likewise be achieved. In FIG. 10, no channel-like grooves are introduced into the outer surfaces 20 of the impeller blades 12 facing the stator 13 but rather multiple recesses 29 are provided, each of which are bounded by rims 30 both on the suction side 19 and also on the pressure side 18, wherein the rims 30 of the recesses 29 form sealing contours of the respective impeller blade 12 towards the stator 13. The recesses 29 introduced into the outer surface 20 of the respective impeller blade 12 in this case are preferentially formed as bores which have a circular cross section and on their circumference are surrounded by rims 30 on all sides. Accordingly, the bores introduced into the outer surface 20 of the respective impeller blade 12 preferentially have different dimensions, namely different bore diameters and/or different bore depths.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A radial compressor stage for a radial compressor having a rotor side, the radial compressor stage comprising:

a stator (13); and an impeller (10) configured to rotate relative to the stator (13), the impeller (10) having multiple impeller blades (12) on the rotor side, wherein each of the multiple impeller blades (12) has:

a flow inlet edge (16), a flow outlet edge (17), a suction side (19) extending between the flow inlet edge (16) and the flow outlet edge (17), a pressure side (18), and an outer surface (20) facing the stator (13), wherein at least one groove (22) is arranged in the outer surface (20) of at least one of the multiple impeller blades (12), the at least one groove (22) being bounded, on the suction side (19) by a suction side longitudinal web (23), and bounded, on the pressure side (18), by a pressure side longitudinal web (24), wherein each of the suction side and pressure side longitudinal webs (23, 24) forms a sealing tip of the respective impeller blade (12) towards the stator (13), wherein the at least one groove (22) of at least one impeller blade of the impeller (10) has a groove depth different from groove depths of grooves (22) of other impeller blades of the impeller (10), a difference in the groove depths being structured and arranged so as to optimize impeller blade natural frequencies or to balance the impeller, and wherein, in at least one impeller blade, an inlet-proximate end of the pressure side longitudinal web (24) extends fully to the flow inlet edge (16) of the at least one impeller blade, while an inlet-proximate end of the suction side longitudinal web (23) does not extend fully to the flow inlet edge (16), so as to form a recess (25), between the inlet-proximate end of the pressure side longitudinal web (24) and the inlet-proximate end of the suction side longitudinal web (23), so that the groove (22) of the at least one impeller blade, by way of the recess (25), opens into the suction side (19) of the respective impeller blade (12), without opening into the pressure side (18).

2. The radial compressor stage according to claim 1, wherein, in at least one impeller blade, the at least one groove (22) is a single groove (22) that extends between the flow inlet edge (16) and the flow outlet edge (17).

3. The radial compressor stage according to claim 2, wherein, in the at least one impeller blade, the single groove (22) closed at a portion adjacent to the flow inlet edge (16).

4. The radial compressor stage according to claim 2, wherein, in the at least one impeller blade, the single groove (22) is open at a portion adjacent to the flow inlet edge (16).

5. The radial compressor stage according to claim 4, wherein, in the at least one impeller blade, the single groove (22) opens adjacent to the flow inlet edge (16) by way of the recess (25).

6. The radial compressor stage according to claim 2, wherein, in the at least one impeller blade, the single groove (22) is open adjacent to the flow outlet edge (17).

7. The radial compressor stage according to claim 1, wherein the at least one groove (22) comprises multiple grooves (22) positioned one behind the other between the flow inlet edge (16) and the flow outlet edge (17), the multiple grooves being separated from one another by at least one transverse web (28).

8. The radial compressor stage according to claim 7, wherein the at least one transverse web (28) extends between the suction side (19) and the pressure side (18) of the respective impeller blade (12).

9. The radial compressor stage according to claim 1, wherein the at least one groove (22) has a V-shaped cross section and a U-shaped or rounded-off groove base (26).

10. The radial compressor stage according to claim 1, wherein each of the suction side and pressure side longitudinal webs (23, 24) has a constant thickness on its outer section.

11. The radial compressor stage according to claim 1, wherein the groove depths vary between the flow inlet edge (16) and the flow outlet edge (17) of at least one impeller blade (12).

* * * * *